United States Patent [19]

Kodama et al.

[11] Patent Number: 4,938,046

[45] Date of Patent: Jul. 3, 1990

[54] SPRING FORMING MACHINE WITH CONVEYING DEVICE

[75] Inventors: Ryozou Kodama; Minoru Yoshida, both of Kyoto, Japan

[73] Assignee: Sanko Senzai Kogyo Kabushiki Kaisha, Kyoto, Japan

[21] Appl. No.: 353,438

[22] Filed: May 18, 1989

[51] Int. Cl.[5] ..... B21F 3/02

[52] U.S. Cl. ..... 72/135; 29/173; 414/744.3; 414/744.8; 414/225

[58] Field of Search ..... 72/135; 29/173; 414/744.3, 744.8, 225

[56] References Cited

U.S. PATENT DOCUMENTS 3,192,748 7/1965 Lange ..... 72/137
3,313,325 4/1967 Wells ..... 72/133
4,236,397 12/1980 Lange ..... 72/137
4,715,114 12/1987 Yajima ..... 414/225

*Primary Examiner*—P. W. Echols
*Attorney, Agent, or Firm*—Armstrong, Nikaido, Marmelstein, Kubovcik & Murray

[57] ABSTRACT

A spring forming machine having an integral conveying device for transporting formed springs from a forming station to a subsequent processing station. The conveying device includes a pair of vertically-spaced, articulated arms (25, 26), with one arm carrying a set of releasable clamping members (28–31), and the other arm having a clamp releasing member (38). The arms are synchronized for operation in relation to each spring forming cycle, by a cooperative combination of swivel, elevation and lifting devices (41, 47, 52).

3 Claims, 8 Drawing Sheets

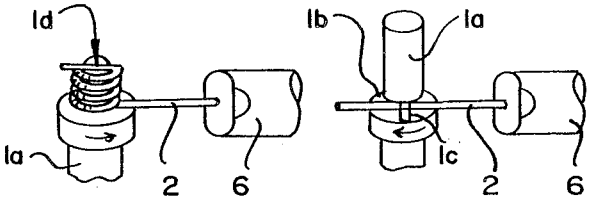
FIG. 10
FIG. 11
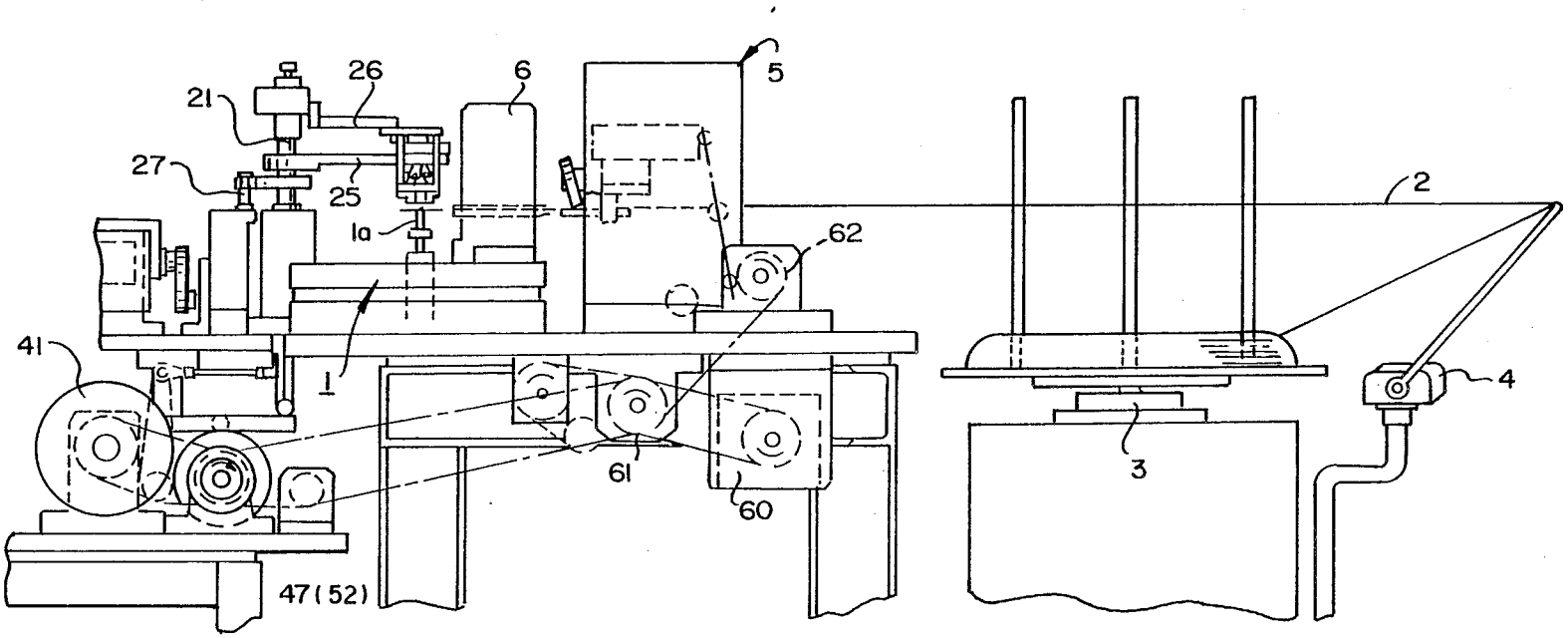
FIG. 9

SPRING FORMING MACHINE WITH CONVEYING DEVICE

BACKGROUND OF THE INVENTION

The present invention relates to a spring forming machine with an integral conveying device for use in direct and automatic feed of pressed springs, helical springs, torsion springs, etc. from a forming machine to an automatic assembly line of the like without requiring the use of a separate parts feeder.

Conventional spring forming machines are roughly classified on the one hand into the pressed spring and helical spring forming machine for intermittently severing a predetermined length of an elongate material, e.g., wire or rod as a hoop, and feeding it to a forming position or station, where it is formed into a desired shape by dies and, on the other hand, a torsion spring forming machine for coiling and forming a material into a specified shape by means of a forming spindle installed to depend or extend perpendicularly downward at a forming position or station. In both types of forming machines after the products are formed they are discharged or released to drop downward under the force of gravity.

When the formed products are discharged by dropping downward spontaneously under the force of gravity, they have a tendency to become entangled or deformed, which causes problems when attempting to assemble the products automatically in the next process.

This invention is proposed in light of the above problems with conventional spring forming machines, and it is therefore a primary object of the invention to provide a spring forming machine with an integral conveying device having a simple structure which is capable of operating accurately and at high speed to remove formed products while preventing entanglement or deformation of the formed products.

SUMMARY OF THE INVENTION

In order to achieve the above object, the invention provides a spring forming machine with an integral conveying device which comprises feed means for intermittenly severing a prescribed length of an elongate material and feeding it to a forming station having forming means including a plurality of dies for forming the elongate material into a described shape, a swivel and elevating shaft supported on a bench near the forming machine in a manner free to shivel and elevate, a first arm affixed to the upper part of the swivel and elevating shaft, a second arm mounted on the swivel and elevating shaft so as to be able to swivel and elevate together with the first arm and also to elevate independently of the first arm, an openable clamp member provided at the end of the first arm, an opening control member of the clamp member disposed at the end of the second arm, an elevating arm elevatably supported on the bench parallel to the swivel and elevating shaft and being capable of elevating the second arm independently of the first arm, means for reciprocatably swivelling the swivel and elevating shaft, means for elevating the swivel and elevating shaft, and lifting means for elevating the elevating arm, wherein the clamp member is reciprocated between a position above the forming station and a next process position by the swivelling means, and the clamp member is elevated by the elevating means at both positions, and the clamp member is opened or closed by the clamping means in relation to this action, and further, the swivel means, the elevating means and the clamping means are operated in relation to the forming action of the forming machine. The invention is similarly applied to a forming machine for forming torsion springs wherein a prescribed length of an elongate material is cut and fed to a forming station where it is coiled and formed into a desired shape by an upwardly projecting forming spindle installed at the forming station.

The material formed by the forming machine as a spring or helical spring is, right after being formed by the die, clamped by the clamp member which is lowered due to descent of the first arm and independent ascent of the second arm, and immediately the first arm and second arm rise together and swivel to reach the next process position, where the product is unclamped by the descent of the first arm and second arm or independent descent of the second arm alone, and is supplied to the next process position.

In the case of the forming machine for torsion springs, since the forming spindle is modified from the conventional perpendicularly suspending structure in the reverse direction, that is, projected upward, the conveying device can be installed above the forming machine, in the same manner as in the case of the forming machine for pressed springs and helical springs.

In either forming machine, since the product is conveyed after every forming step, entanglement or deformation of the formed products may be prevented.

Being constituted in this way, the invention brings about, among others, the following effects.

In a spring forming machine with conveying device, various formed springs and helical springs can be clamped after every forming step and conveyed to a subsequent or next process position where they can be immediately assembled automatically, while preventing entanglement and deformation of the formal springs.

In the other spring forming machine with the conveying device, torsion springs can be clamped after every forming step and conveyed to a next process position where they can be immediately assembled automatically, while preventing entanglement or deformation of the formed springs.

In a preferred embodiment of the spring forming machine with an integral conveying device, the actions of the components can be accurately matched with the operation of the forming machine by the function of a control cam, so that high speed operation is achieved in a simple structure.

BRIEF DESCRIPTION OF THE DRAWINGS

FIG. 9 is a side elevation of an entire structure showing a second embodiment of the invention; and FIG. 10 and FIG. 11 are perspective views for explaining different embodiments of the forming spindle in FIG. 9.

DETAILED DESCRIPTION OF THE PREFERRED EMBODIMENTS

Figure 1:
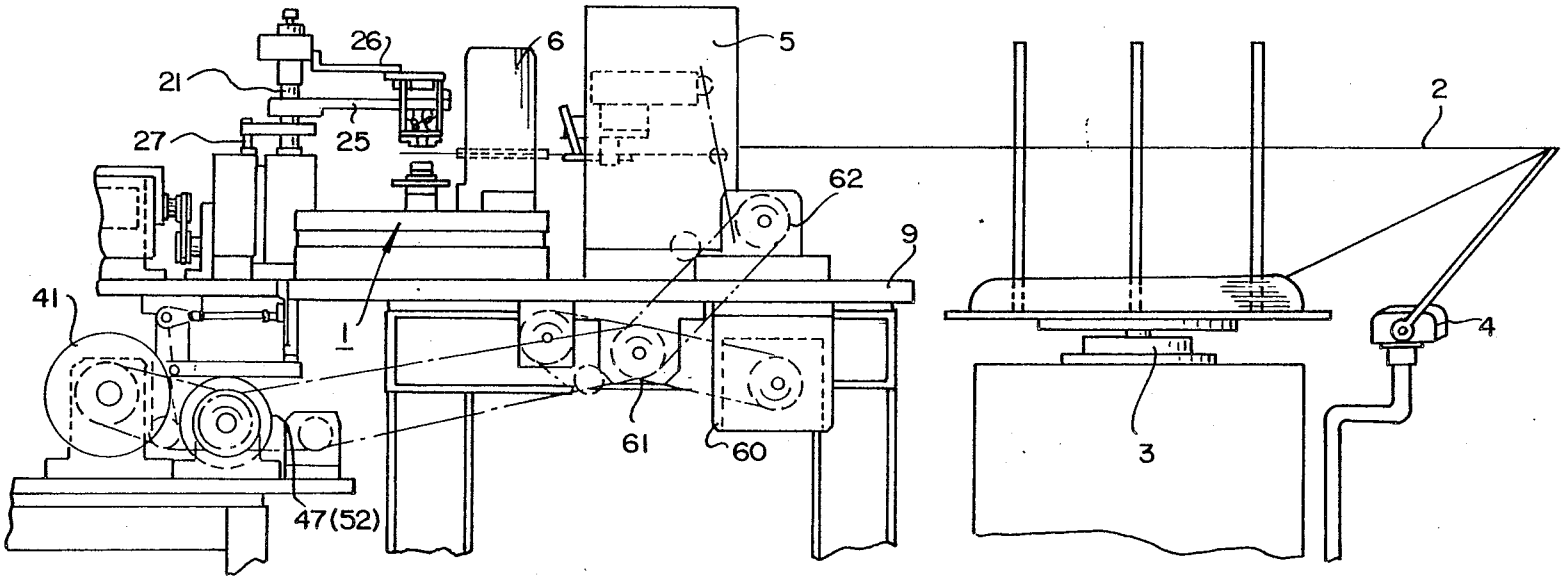
FIG. 1 is a side elevation of an entire structure showing a first embodiment of the invention.

Referring now to the drawings, the preferred embodiments of the invention will be described in detail.

Figure 2:
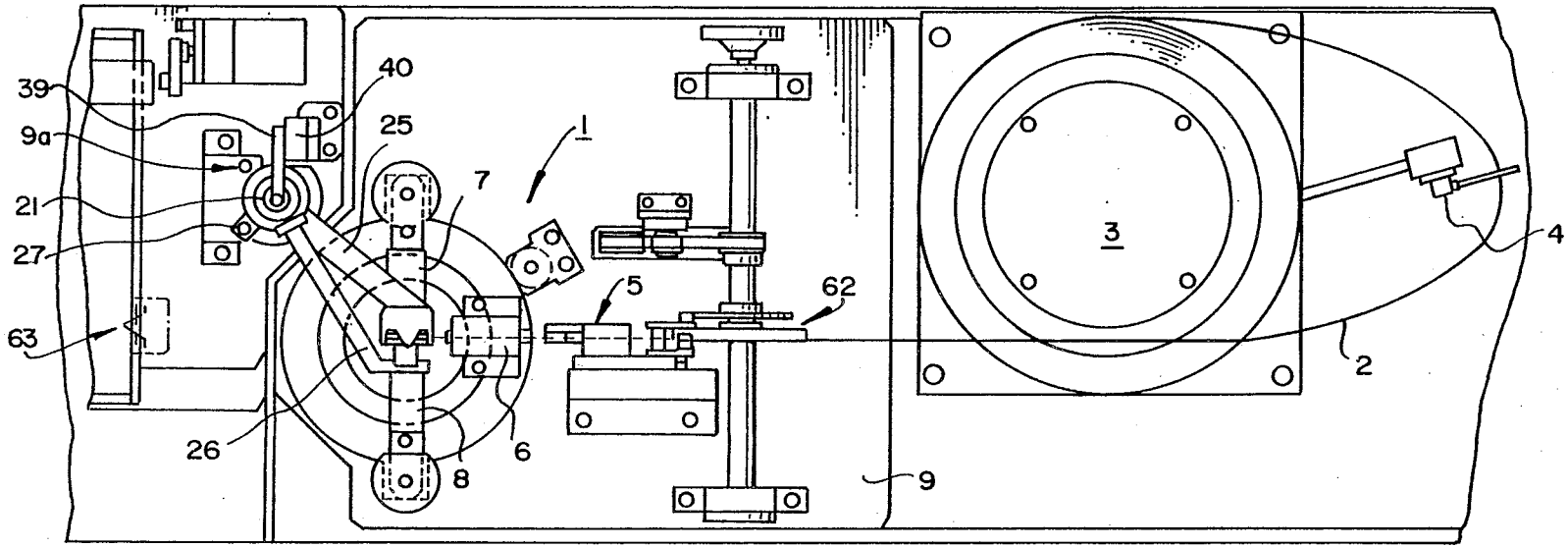
FIG. 2 is a plan view of the structure of FIG. 1.

FIG. 1 is a side view of an embodiment of the invention in a forming machine for pressing springs and forming helical springs, and FIG. 2 is its plan view. In these drawings, a forming machine 1 severs and feeds prescribed lengths of elongate material 2 from a reel stand 3 into a pair of dies 7, 8, by way of a tension controller 4, a material feed mechanism 5 and a material guide 6, and forms the material 2 into a desired shape.

Figure 3:
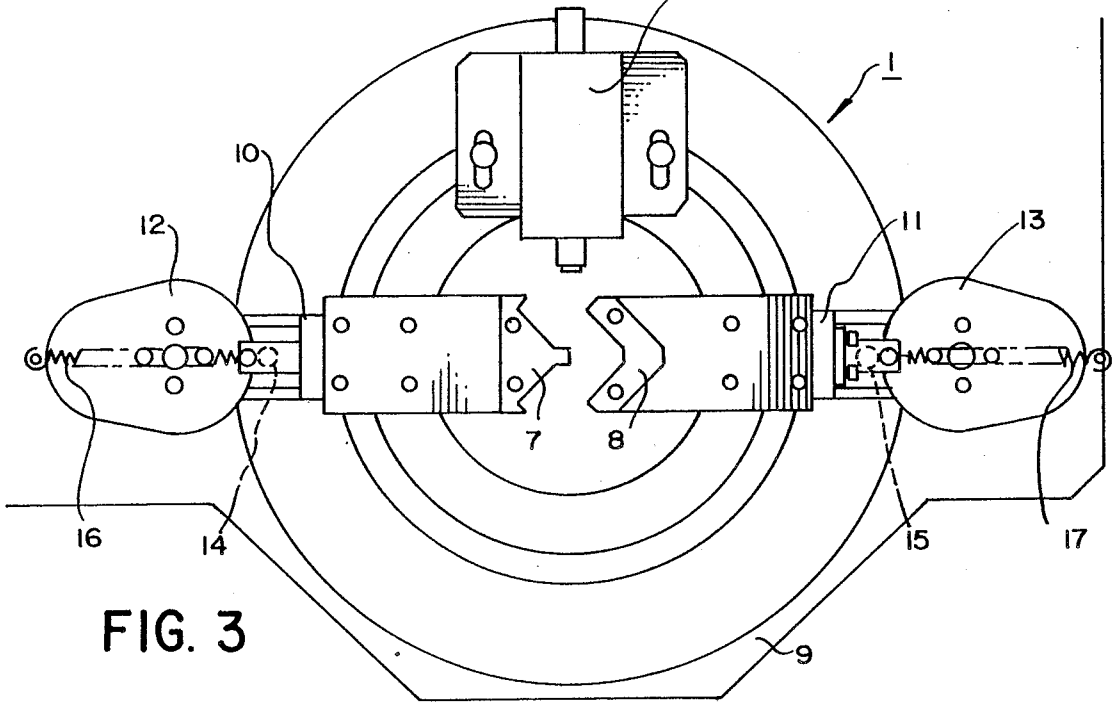
FIG. 3 is an enlarged plan view of the forming machine portion of FIG. 1.
Figure 4:
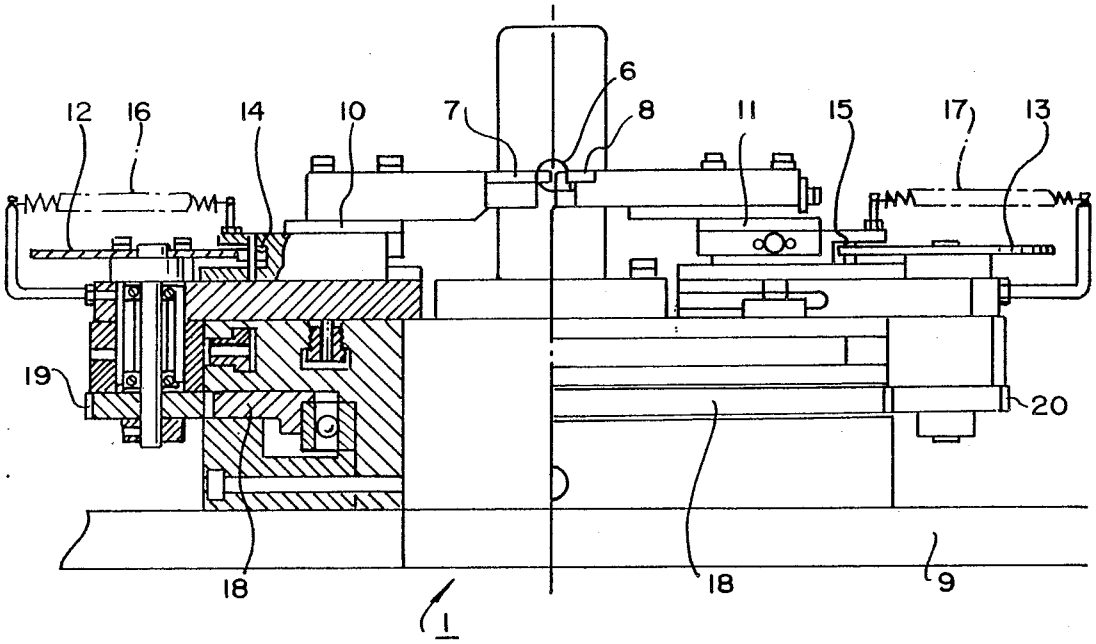
FIG. 4 is a partially cut-away side elevation of FIG. 3.

The dies 7, 8 are affixed to sliders 10, 11 which are slidably mounted horizontally on bench 9 as shown in FIG. 3 and FIG. 4, and these sliders 10, 11 are movable horizontally in opposite directions to approach and withdraw from each other through driven rollers 14, 15, by means of cams 12, 13, which operate in relation to the supply action of the material 2. The driven rollers 14, 15 are always pressed against the cams 12, 13 by means of springs 16, 17.

The cams 12, 13 are caused to cooperate by a gear 18 through pinions 19, 20.

The material 2 is supplied through the material guide 6 in a direction orthogonal to the direction of movement of the dies 7, 8.

Figure 5:
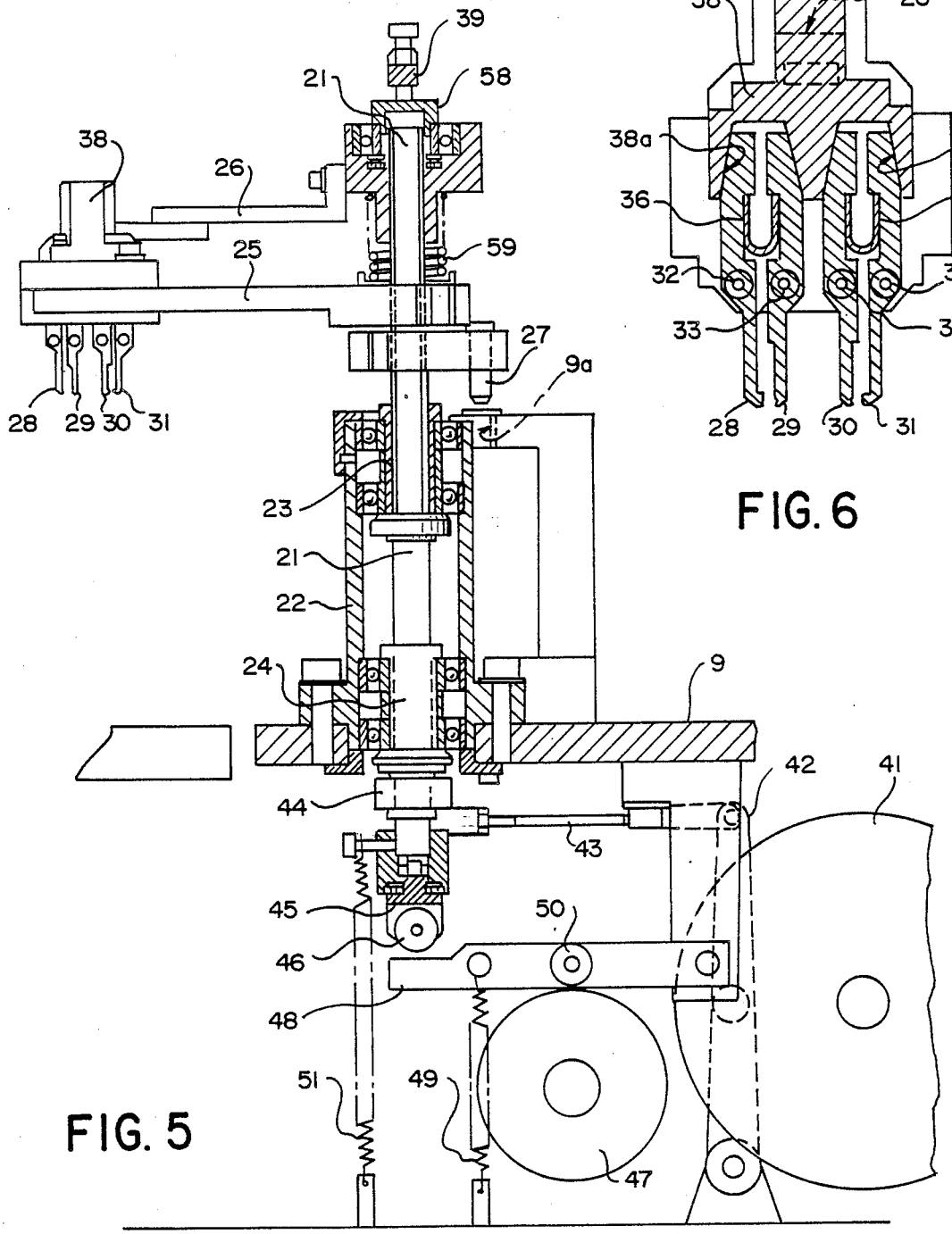
FIG. 5 is an enlarged longitudinal sectional view of the conveying device portion of FIG. 1.

On the bench 9 near the forming machine 1, a swivel and elevating shaft 21 is installed. The swivel and elevating shaft 21 is, as shown in FIG. 5, supported in a support tube 22 in a manner free to swivel and elevate by way of guide tubes 23, 24, and a first arm 25 is affixed to its upper part. A second arm 26 is further disposed thereabove by a spline fitting so as to be able to elevate independently of and swivel together with the first arm 25.

Figure 6:
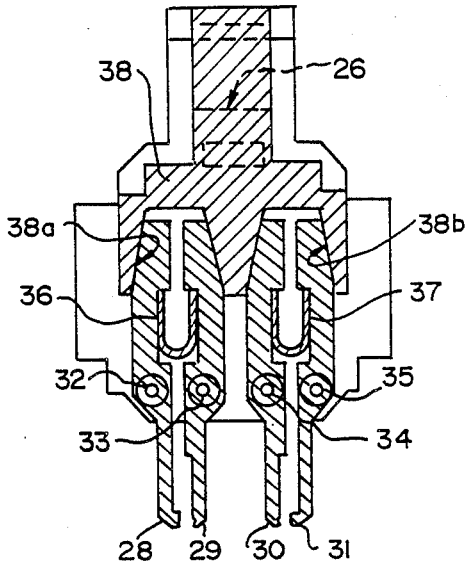
FIG. 6 is an enlarged side view of the clamp member portion of FIG. 5.

At the end of the first arm 25, as shown in FIG. 6, two sets of clamp members 28, 29, 30, 31 are openably pivoted on pivots 32, 33, 34, 35, and are always provided with a clamping force in the closing direction by springs 36, 37. An opening control member 38 is elevatably mounted on the clamp members 28, 29, 30, 31.

The opening control member 38 is affixed to the end of the second arm 26, and has taper grooves 38*a*, 38*b* formed so as to correspond to the upper end taper parts of the clamp members 28, 29, 30, 31. When the second arm 26 is located at a lowered position with regard to the first arm 25, the clamp members 28, 29, 30, 31 are released by the member 38 overcoming the springs 36, 37, and when at a raised position, the clamp members 28, 29, 30, 31 are designed to be closed by the springs 36, 37.

Figure 7:
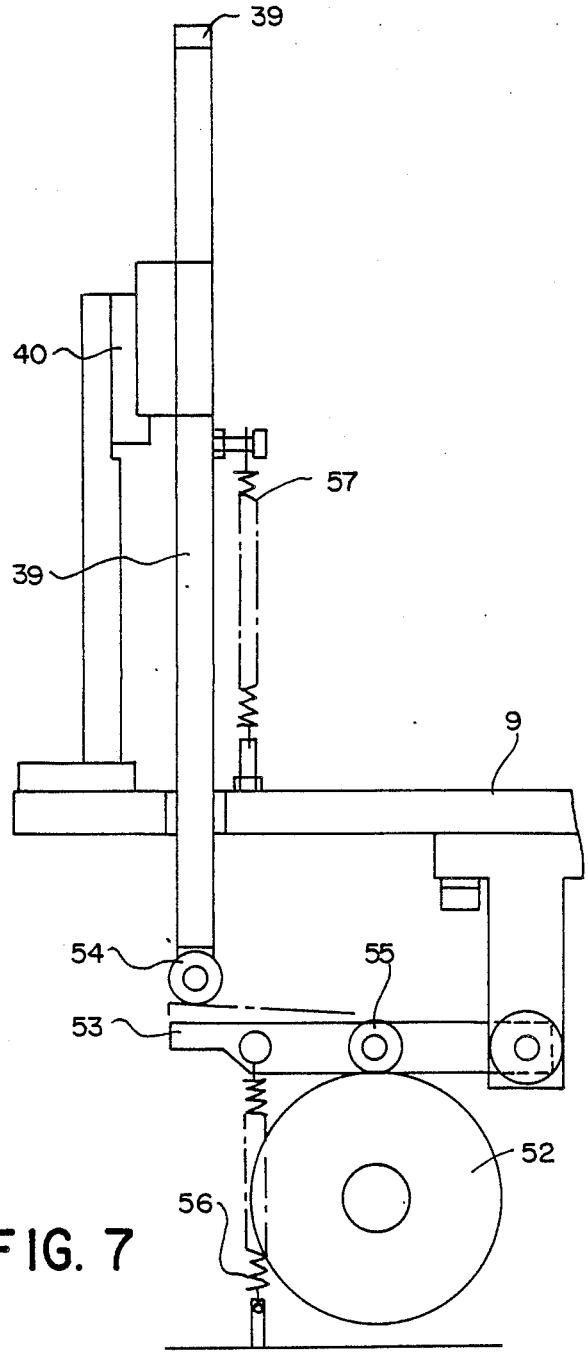
FIG. 7 is an enlarged longitudinal sectional view of clamping means related with FIG. 5.

The second arm 26 is moved up and down by an elevating lever or arm 39 shown in FIG. 7, and this elevating arm 39 is elevatably supported on the bench 9 through a guide 40 being parallel to the swivel and elevating shaft 21, and the configuration with the swivel and elevating shaft 21 is such that they are overlapped in the front-to-back direction as reviewed in the plane of the sheet of paper in FIG. 5.

The swivel and elevating shaft 21 swivels reciprocatably by means of a swivel cam 41 through an oscillating lever 42, a link 43, and a lever 44 as shown in FIG. 5. That is, the lever 44 is affixed beneath the swivel and elevating shaft 21, and this lever 44 is coupled to the oscillating lever 42 through the link 43, and the oscillating lever 42 is fitted in a cam groove (not shown) in the swivel cam 41 so as to oscillate in a reciprocative manner. By this swivel cam 41, the clamp members 28, 29, 30, 31 at the end of the first arm 25, affixed to the swivel and elevating shaft 21, are reciprocated between a first position above the forming station of the dies 7, 8 of the forming machine 1, and a spring supplying position 63 where formed springs are supplied to a conveyor or the next process position or the like. At both positions, positioning holes 9*a* are provided in parts of the bench 9, and a corresponding positioning pin 27 is fixed on the swivel and elevating shaft 21 (see FIG. 2, FIG. 5).

At the lower end of the swivel and elevating shaft 21, there is a roller 46 mounted upon a swivel seat 45, as shown in FIG. 5, and this roller 46 abuts against the upper face of the end of a lever 48 oscillating vertically by an elevation cam 47, and is moved up and down. The lever 48 is designed so that a driven roller 50 may be pressed against the elevation cam 47 by a spring 49, and the swivel and elevating shaft 21 is composed so that the roller 46 may be pressed against the upper face of the end of the lever 48 through a spring 51.

The lower end of the elevating arm 39 abuts against the upper face of the end of a lifting and lowering lever 53 oscillated vertically by a clamping cam 52, as shown in FIG. 7, through a roller 54, and is thereby moved up and down. The lever 53 has a spring 56 built in so as to be pressed against the clamping cam 52 through a driven roller 55, and oscillates vertically. The elevating arm 39 is designed so that the roller 54 at the lower end may be pressed against the upper face of the end of the lever 53 by spring 57. The upper end of the elevating arm 39 is, as shown in FIG. 5, coupled with the second arm 26 at the upper end of the swivel and elevating shaft 21 through a swivel seat 58, thereby making it possible to elevate the second arm 26 independently of the first arm 25 by the elevating motion of the elevating arm 39. A spring 59 is installed between the first arm 25 and the second arm 26 to raise the second arm 26.

The swivel cam 41, the elevation cam 47, and the clamping cam 52 are driven by a motor 60 with a reducing gear used as the drive source of the forming machine 1 shown in FIG. 1, by way of a synchronous transmitting mechanism 61 such as a timing belt. The material feed mechanism 5 and dies 7, 8 of the forming machine 1 are driven through a cam by the motor 60 with reducing gear, and the timing diagrams of these cams are shown in FIG. 8.

Figure 8:
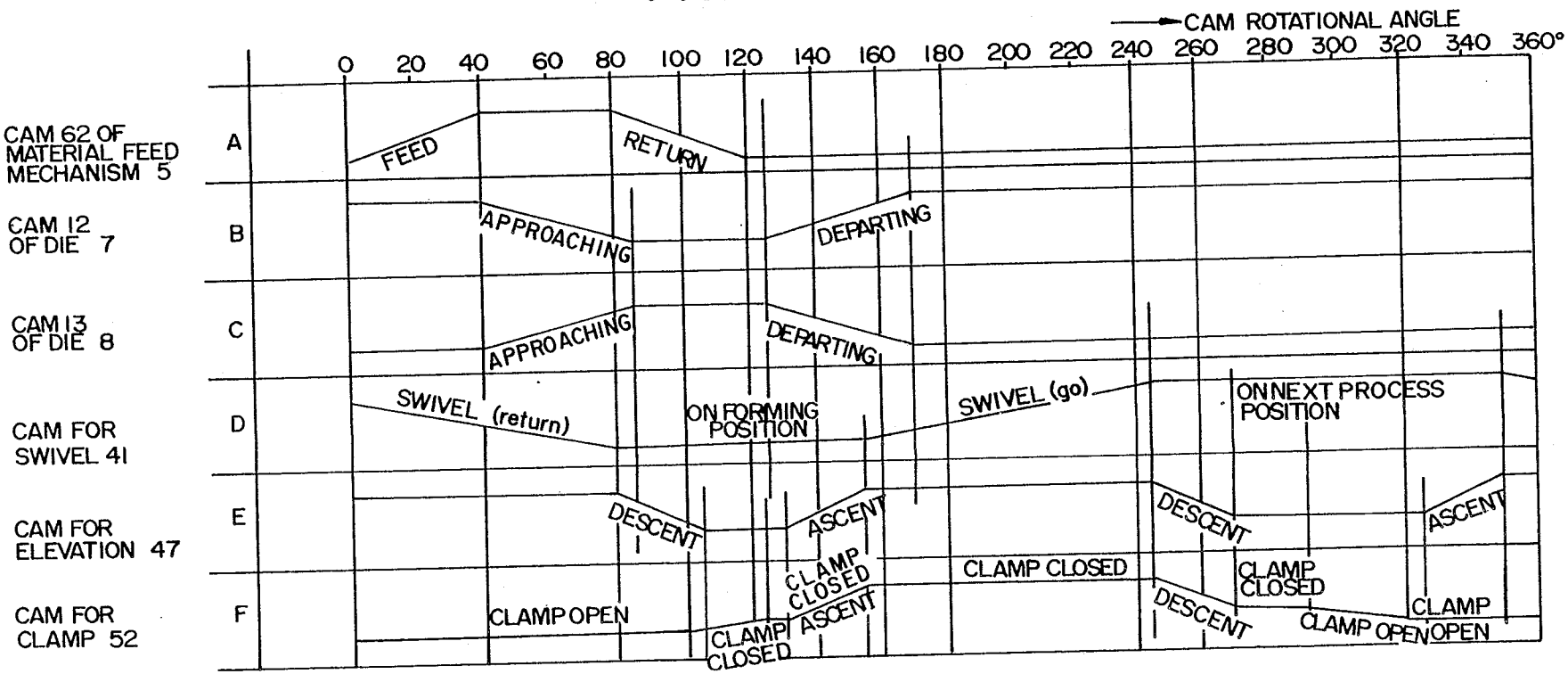
FIG. 8 is a timing diagram of cam curves for coordinating the components in action.

In FIG. 8, A is a cam curve of the material feed mechanism 5. B and C are cam curves of dies 7, 8. D is a cam curve of the swivel cam 41. E is a cam curve of the elevation cam 47, and F is a cam curve of the clamping cam 52.

The first embodiment of the invention is composed as described above, and its operation is as explained below.

To begin with, the initial position of the cams is as shown in FIG. 8, and the clamp members 28, 29, 30, 31 are in an unclamped state, and are in a position to return from the next process position to the forming station side of the machine. The dies 7, 8 are at remote positions, and in this state, the material feed mechanism 5 feeds a specified length of the material 2 through a cam 62. At the end of this feed, the dies 7, 8 begin to approach each other and the material 2 is formed into a desired shape. Just before the end of this forming, the clamp members 28, 29, 30, 31 at the end of the first arm 25 reach the forming station through swivel movement of the swivel and elevating shaft 21 by the swivel cam 41, and in succession the clamp members 28, 29, 30, 31 at the end of the first arm 25 are lowered toward the dies 7, 8 at the forming station through the swivel and elevating shaft 21 by the elevation cam 47. In this descent motion, the first arm 25 and the second arm 26 are lowered together in unclamped state, and just before the end of the lowering movement, the opening control member 38 at the end of the second arm 26 is raised independently upward through the elevating arm 39 by the clamping cam 52, and the product formed in a specified shape is clamped by the clamp members 28, 29, 30, 31. After this clamping, the first arm 25 and second arm 26 are raised together by the same amount by the elevation cam 47 and the clamping cam 52, so that the product is lifted from the forming station. Slightly before this moment, the dies 7, 8 have started to retreat and withdraw from each other as indicated by cam curves B, C in FIG. 8, so that the formed product can be removed.

When the first arm 25 and second arm 26 reach the end of the lifting or elevating movement, they immediately swivel by means of the swivel cam 41 so as to feed the product to the next process, and at the end of this swivel, that is, above the next process position 63, the first arm 25 and the second arm 26 are lowered together by the same amount by mens of the elevation cam 47 and the clamping cam 52 until they reach the end of their descent, where only the second arm 26 is lowered independently by the clamping cam 52 to release the clamp members 28, 29, 30, 31, so that the product is unclamped. In consequence, by means of the elevation cam 47, the first arm 25 is raised and returned with the second arm 26 to above the process position 63, and swiveled to return to a position above the forming station by means of the swivel cam 41, whereby the components and cams return to the initial state as shown in FIG. 8. In the swivel and return process from the next process position to the forming station, the first arm 25 is at the upper end of its ascent, while the second arm 26 is at the lower end of its descent, and therefore the clamp members 28, 29, 30, 31 are held in the unclamped or released state by the opening control member 38, and this state is maintained until the next product is gripped at the forming position.

Thereafter, the same operation is repeated.

FIG. 9 is a side view showing a second embodiment of the invention, in which a forming machine 1 is a forming machine for forming torsion springs, and the clamp members 28, 29, 30, 31 are slightly modified for holding a torsion spring, but all of the other structure is similar to that of the first embodiment. More specifically, as shown in FIG. 10 or FIG. 11, a forming spindle 1*a* projecting upward at the forming station sequentially repeats an ascending and descending movement by a specific extent, while rotating by a specific amount in a specific direction. The spindle 1*a* has a split groove 1*d* disposed at the upper end as shown in FIG. 10, and it forms a specified torsion spring by rotating during the ascending movement with a severed length of the material 2 caught in the split groove 1*d*. Alternatively, as shown in FIG. 11, a stepped part 1*b* of a large diameter may be provided to a lower part of spindle 1*a* and a protrusion 1*c* eccentrically disposed on the stepped part 1*b*. In this embodiment the material 2 is lowered while rotating with its start end gripped between the spindle 1*a* and the protrusion 1*c*, so that a torsion spring of a desired shape is formed. In relation to this forming action, the clamp members 28, 29, 30, 31 are operated in the same manner as in the first embodiment.

In the foregoing embodiments, cam mechanisms are disclosed as the swivel means, elevation means and lifting means, but this disclosure is not limiting, since the cam mechanism may be replaced for example by electric actuators or fluid pressure actuators, which may be automaticallly operated in relation to the forming action of the forming machine.

What is claimed is:

1. A spring forming machine with an integral conveying device comprising:

feed means for intermittenly severing a prescribed length of an elongate material and feeding it to a forming station having forming means including a plurality of dies for forming said elongate material into a desired shape, a bench, a swivel and elevating shaft supported on said bench for vertical movement and swivel movement, a first arm fixed to an upper part of said swivel and elevating shaft, a second arm mounted on the swivel and elevating shaft to swivel and elevate with said shaft and to move vertically independently of said shaft, openable clamp members fitted to the end of said first arm and biased to a closed position, a member for opening said clamp members fitted to the end of said second arm, an elevating arm supported on said bench, said elevating arm being parallel to said swivel and elevating shaft and mounted for vertical movement to vertically move said second arm independently of said first arm, swivel means for reciprocatably swiveling the swivel and elevating shaft, elevating means for vertically moving the swivel and elevating shaft, and lifting means for elevating the elevating arm, wherein said swivel means is operative to swivel said swivel and elevating shaft to move said clamp members between a first position above said forming station and a next process position, said elevating means is operative to lower said clamp members at said first position to engage formed material and then raise said clamp members vertically at said first position and lower said clamp members at said next process position, and said lifting means is operative at said next process position to lower said elevating arm and said member for opening said clamp members toward said first arm to open said clamp members and release said formed material at said net process position, and said swivel means, elevating means and lifting means are operated in relation to said forming means to clamp each formed material as it is formed at said forming station and move it to said next process position.

2. A spring forming machine with an integral conveying device comprising:

feed means for intermittenly severing a prescribed length of an elongate material and feeding it to a forming station having forming means including an upstanding forming spindle for receiving said elongate material and forming said elongate material into a described shape, a bench, a swivel and elevating shaft supported on said bench for vertical movement and swivel movement, a first arm fixed to an upper part of said swivel and elevating shaft, a second arm mounted on the swivel and elevating shaft to swivel and elevate with said shaft and to move vertically independently of said shift, openable clamp members fitted to the end of said first arm and biased to a closed position, a member for opening said clamp members fitted to the end of said second arm, an elevating arm supported on said bench, said elevating arm being parallel to said swivel and elevating shaft and mounted for vertical movement to vertically move said second arm independently of said first arm, swivel means for reciprocatably swiveling the swivel and elevating shaft, elevating means for vertically moving the swivel and elevating shaft, and lifting means for elevating the elevating arm, wherein said swivel means is operative to swivel said swivel and elevating shaft to move said clamp members between a first position above said forming station and a next process position, said elevating means is operative to lower said clamp members at said first position to engage formed material and then raise said clamp members vertically at said first position and lower said clamp members at said next process position, and said lifting means is operative at said next process position to lower said elevating arm and said member for opening said clamp members toward said first arm to open said clamp members and release said formed material at said next process position, and said swivel means, elevating means and lifting means are operated in relation to said forming means to clamp each formed material as it is formed at said forming station and move it to said next process position.

3. A spring forming machine with an integral conveying device as defined by claim 1 or 2, further including a power a source for driving said forming means and wherein said swivel means, said elevating means and said lifting means are operated by a cam mechanism driven by said power source driving said forming means.

* * * * *